US012448792B2

(12) United States Patent
Najjar et al.

(10) Patent No.: US 12,448,792 B2
(45) Date of Patent: Oct. 21, 2025

(54) FORM ELEMENT, ARRANGEMENT OF THE FORM ELEMENT AND METHOD FOR FORMING AT LEAST ONE PART OF A FORMWORK FOR A CONCRETE PART WITH THE FORM ELEMENT

(71) Applicants: Rames Najjar, Vienna (AT); Ivan Tochev, Vienna (AT)

(72) Inventors: Victor Said Najjar, Vienna (AT); Ivan Tochev, Vienna (AT)

(73) Assignees: Rames Najjar, Vienna (AT); Ivan Tochev, Vienna (AT)

( * ) Notice: Subject to any disclaimer, the term of this patent is extended or adjusted under 35 U.S.C. 154(b) by 949 days.

(21) Appl. No.: 17/616,377

(22) PCT Filed: Jun. 5, 2020

(86) PCT No.: PCT/EP2020/065633
§ 371 (c)(1),
(2) Date: Dec. 3, 2021

(87) PCT Pub. No.: WO2020/245360
PCT Pub. Date: Dec. 10, 2020

(65) Prior Publication Data

US 2022/0325540 A1 Oct. 13, 2022

(30) Foreign Application Priority Data

Jun. 6, 2019 (AT) ..... A 50513/2019

(51) Int. Cl.
*E04G 9/08* (2006.01)
*E04G 17/14* (2006.01)

(52) U.S. Cl.
CPC ..... *E04G 9/08* (2013.01); *E04G 17/14* (2013.01)

(58) Field of Classification Search
CPC ..... E04G 9/08; E04G 11/045; E04G 11/062; E04G 11/04; E04G 11/065; B28B 7/025; B28B 7/0091; B28B 7/02
See application file for complete search history.

(56) References Cited

U.S. PATENT DOCUMENTS 2,659,124 A 11/1953 Henry
4,579,312 A * 4/1986 White ..... E04G 9/08 249/7

(Continued)

FOREIGN PATENT DOCUMENTS

AT 410342 B 3/2003
AT 510664 A1 5/2012

(Continued)

OTHER PUBLICATIONS

Preliminary Report dated Sep. 15, 2021 of Application No. PCT/EP2020/065633.

(Continued)

*Primary Examiner* — Gisele D Ford
(74) *Attorney, Agent, or Firm* — Gordon & Jacobson, P.C.

(57) ABSTRACT

The invention relates to a form element (1), an arrangement comprising such a form element (1) and a method for forming at least part of a formwork for a concrete part using this form element (1), wherein the form element (1) is flexibly three-dimensionally deformable in its first state, and wherein the form element (1) is stiffened and solidified in its second state, in particular in a deformed position of the form element (1), wherein the form element (1) comprises at least two flexible layers (2), which are arranged superimposed in a planar manner, and wherein the layers (2) are connected to each other, in particular reversibly, in the second state to solidify the form element (1).

22 Claims, 8 Drawing Sheets

(56) References Cited

U.S. PATENT DOCUMENTS

| | | | | |
|---|---|---|---|---|
| 4,723,751 | A * | 2/1988 | Hale | E04G 11/045 264/32 |
| 7,574,830 | B2 * | 8/2009 | Baker | E04C 5/06 52/81.3 |
| 2008/0088056 | A1 * | 4/2008 | Vavra | E04G 11/062 249/1 |
| 2010/0117248 | A1 * | 5/2010 | Christiansen | B28B 7/346 249/1 |
| 2022/0126553 | A1 * | 4/2022 | Villaescusa | D21H 27/32 |

FOREIGN PATENT DOCUMENTS

| | | | |
|---|---|---|---|
| DE | 19823610 | A1 | 12/1999 |
| DE | 10033408 | A1 | 1/2002 |
| EP | 3002392 | A1 | 4/2016 |
| GB | 1556507 | | 11/1977 |

OTHER PUBLICATIONS

International Search Report dated Sep. 22, 2020 of Application No. PCT/EP2020/065633.

* cited by examiner

FORM ELEMENT, ARRANGEMENT OF THE FORM ELEMENT AND METHOD FOR FORMING AT LEAST ONE PART OF A FORMWORK FOR A CONCRETE PART WITH THE FORM ELEMENT

CROSS-REFERENCE TO RELATED APPLICATIONS

This application is a National Stage of International Patent Application No. PCT/EP2020/065633 filed on Jun. 5, 2020, which claims priority from Austrian Patent Appl. No. A50513/2019 filed on Jun. 6, 2019, which are hereby incorporated by reference herein in their entireties.

BACKGROUND

1. Field

The invention relates to a form element, an arrangement of the form element and a method in accordance with the preambles of the independent patent claims.

2. State of the Art

The prior art discloses different methods for producing formwork, which, for example, act as casting molds for concrete components. Conventional formwork systems often comprise multiple rigid plate elements made of wood and a supporting structure for holding these plate elements. However, the disadvantage of these conventional formwork methods is that, in order to be able to produce three-dimensionally deformed concrete parts, irreversibly three-dimensionally deformed formwork elements must be used. These formwork elements have to be formed into the desired shape in advance by means of conventional processing methods and generally cannot be reused.

Conventional form elements are known from GB 1 556 507 A, U.S. Pat. No. 2,659,124 A and EP 3 002 392 A1, among others.

SUMMARY

The object of the invention is to overcome the disadvantages of the state of the art. In particular, the object of the invention is to provide a form element for forming at least part of a formwork for a concrete part, which can be easily and reversibly three-dimensionally deformed. The object of the invention is, among other things, to create a form element which, due to its reversible deformability, can be used several times in a wide variety of forms as a formwork element and is thus more cost-effective and environmentally friendly than conventional formwork elements. Furthermore, the form element should be able to be formed into the desired shape directly at the place where the formation of the concrete part is to take place, for example at a construction site.

The object according to the invention is solved in particular by the features of the independent patent claims.

The invention relates in particular to a form element for forming at least part of a formwork for a concrete part, the form element being flexibly and three-dimensionally deformable in its first state, and the form element being stiffened and solidified in its second state, in particular in a deformed position of the form element.

Preferably, it is provided that the form element comprises at least two flexible layers which are arranged one above the other in a planar manner, and that the layers are connected to one another, in particular reversibly, in the second state to solidify the form element.

The form element can be used to form a formwork for a concrete part or a concrete component. That is, the form element and/or the layers of the form element are preferably configured to absorb the forces occurring during the creation of a concrete part or a concrete component, such as the concrete pressure occurring during the formwork. In its second state, the form element may in particular be stiffened and solidified such that it can withstand the occurring forces.

In its first state, the form element can be flexibly and three-dimensionally deformed. In particular, the form element can be deformed into a single-curved, preferably developable, surface. Preferably, the form element can be deformed into a double-curved, preferably non-developable, surface.

In its first state, the form element can be flexibly and three-dimensionally deformed starting from any shape. On the one hand, the form element can be deformed in its first state starting from any shape. On the other hand, the form element can be brought into its second state in any shape and thus be stiffened and/or solidified.

In other words, the form element can be brought into its second state both in an undeformed state and in a deformed state for its stiffening and solidification.

Optionally, it is provided that the form element comprises 2 up to and including 500 layers, in particular 5 up to and including 100 layers, or that the form element is formed from 2 up to and including 500 layers, in particular 5 up to and including 100 layers.

Preferably, the form element may comprise two, three, four, five, six, seven, eight, nine, ten, eleven, twelve, thirteen, fourteen, fifteen, sixteen, seventeen, eighteen, nineteen or twenty layers.

Preferably, the layers are arranged one above the other in a planar manner and/or extend in a planar manner, in particular mainly along their main directions of extension. Each layer may extend in three directions, the longitudinal and transverse extension of the respective layer preferably being many times greater than its height.

In the context of the present invention, the planar extent or planar extension of the respective layer may be understood as extension along the main directions of extension of the layer. In other words, by the planar extension of the respective layer, this layer may form a wide surface and/or this layer may spread on a surface.

Optionally, it is provided that, in the second state, the layers are pressed together in a planar manner and are thereby in particular non-positively connected to one another.

Due to the fact that the layers can be pressed together in a planar manner in the second state, the various layers, in particular the adjacent layers lying one above the other and/or one on top of the other, are connected to one another, in particular in a non-positive and/or frictional manner.

Preferably, in the second state, the layers can be connected to one another exclusively non-positively, in particular exclusively by frictional force.

Optionally, in the second state of the form element, the connection, in particular the non-positive connection, of the layers is effected by magnetic force. In particular, in the second state of the form element, the layers can be pressed together in a planar manner by magnetic force, as a result of which the form element is stiffened.

For this purpose, the form element may comprise at least one magnet, in particular at least one permanent magnet and/or at least one electromagnet, and/or at least one magnetic substance. However, at least one magnet, in particular at least one permanent magnet and/or at least one electromagnet, and/or at least one magnetic substance may also be arranged on the form element in such a way that the magnetic force which can be generated by this at least one magnet presses the layers together in the second state of the form element and, in particular, connects them in a non-positive manner. The at least one magnet may be configured to press the layers together in the second state of the form element such that the form element is stiffened.

It may be provided that the form element comprises at least one pair of magnets. Furthermore, however, at least one pair of magnets may be arranged on the form element in such a way that the magnetic force which can be generated by at least one magnet of the pair of magnets, presses the layers together in the second state of the form element and, in particular, connects them in a non-positive manner.

In a first embodiment, at least one pair of magnets may comprise at least one permanent magnet and at least one electromagnet. The at least one electromagnet may comprise at least one ferromagnetic core.

The form element and the magnets may be configured such that when no current flows through the coil of the electromagnet, the core of the electromagnet is attracted by the permanent magnet, thereby connecting the layers to one another, in particular reversibly and in a non-positive manner, to solidify the form element. Further, the form element and the magnets may be configured such that when current flows through the coil of the electromagnet, the field generated by the electromagnet balances and/or cancels out the field generated by the permanent magnet. This allows the form element to be brought into its first state, in which it is flexibly and three-dimensionally deformable. In particular, the current applied to the electromagnet and/or the polarity of the at least one magnet can be set accordingly.

In a second embodiment, at least one pair of magnets may comprise at least two electromagnets.

In a third embodiment, at least one pair of magnets may comprise at least two permanent magnets.

In particular, it may be provided that at least one magnet can be rotated, in particular by 180°. When the magnets are rectified, the magnetic fields generated by the magnets may add up, thereby pressing the layers together in the second state and stiffening the form element. When the magnets are oppositely directed, the magnetic fields generated by the magnets may subtract and/or cancel each other out, thereby bringing the form element into its first state, in which it is flexibly and three-dimensionally deformable.

Optionally, the connection, in particular the non-positive connection, of the layers in the second state of the form element is effected by a device, in particular a screw, a clamp or the like.

Optionally, in the first state, it is provided that at least one layer is arranged so as to be movable relative to at least one other layer, in particular relative to an adjacent layer, along its planar extension, and/or that, in the second state, at least one layer is connected to at least one other layer, in particular an adjacent layer, transversely, in particular normal, to its planar extension to solidify the form element.

In the context of the present invention, a movement of a layer along its planar extension may be understood as the direction, in which the layer extends in a planar manner and/or the direction which follows the surface of the respective layer.

In the context of the present invention, the adjacent layer may be understood as the layer which is located below and/or above a layer.

Due to the fact that, in the first state of the form element, the layers are arranged so as to be movable and/or displaceable relative to one another along their planar extension, the form element can be deformed three-dimensionally and flexibly.

To solidify the form element, the layers can be pressed together in the second state of the form element, in particular in a non-positive and/or frictional manner, normal to the planar extension of the respective layer.

In particular, each layer of the form element may be arranged so as to be movable relative to any other layer, preferably relative to each adjacent layer.

Optionally, it is provided that at least one layer is formed from at least one stiffening element, and/or that at least one layer comprises at least one stiffening element, and/or that at least one stiffening element of one layer overlaps at least one stiffening element of another layer, in particular one stiffening element of an adjacent layer.

Preferably, the at least one stiffening element may be, in particular substantially, incompressible and/or, in particular substantially, inductile. Preferably, the layers, in particular the stiffening elements of the layers, are configured to be connected to one another, in particular reversibly, by a vacuum and/or by negative pressure.

By means of a vacuum, in particular a vacuum generated by a vacuum pump in the airtight envelope, sufficiently high contact pressures can optionally be generated, whereby the layers, in particular the stiffening elements of the various layers, can be connected. In particular, by generating a vacuum in the airtight envelope, the whole surface of the form element, in particular of the individual layers, can be used.

The stiffening elements may be made of paper, wood, textile, metal, plastic, spring steel and/or composite materials. The stiffening elements may comprise paper, wood, textile, metal, plastic, spring steel and/or composite materials.

In particular, it may be provided that one layer consists of only one stiffening element.

In order to be able to increase the contact surfaces or the friction of the form element, the form element and in particular each layer may comprise a plurality of thin stiffening elements. Preferably, each layer comprises 5 up to and including 1000, in particular 50 up to and including 500, preferably 50 up to and including 200, stiffening elements. In particular, each layer comprises 2 up to and including 500, in particular 25 up to and including 250, preferably 25 up to and including 100, stiffening elements per $m^2$ of the form element.

In particular, each stiffening element has a width of 0.1 cm up to and including 10 cm, in particular a width of 2 cm up to and including 6 cm. In particular, each stiffening element has a length of 1 cm up to and including 100 cm, in particular a length of 20 cm up to and including 30 cm.

Optionally, it is provided that at least two stiffening elements are arranged substantially one above the other and form a stack, and that the stack is inserted into at least one other stack in a comb-like manner such that the stiffening elements of the one stack project between the stiffening elements of the at least one other stack.

In the context of the present invention, "stack" may be understood as an arrangement of at least two stiffening elements which lie substantially one above the other and/or on top of each other. In other words, the stiffening elements are optionally stacked one on top of the other like cards in a card game, for example. On the one hand, the stiffening elements of the stack may be arranged substantially one above the other. On the other hand, the stiffening elements of the stack may also project beyond one another, especially in their main directions of extension.

In the context of the present invention, "inserted into one another in a comb-like manner" may be understood as interlocking or nesting of two stacks, with the stiffening elements of one stack protruding between the stiffening elements of at least one other stack.

Optionally, one stack may be connected to another stack via a single stiffening element. This means that, optionally, the single stiffening element connecting the two stacks is inserted into the stacks so that this stiffening element projects between the stiffening elements of the respective stacks.

Preferably, in the first state and/or in the second state of the form element, at least one stiffening element of at least one stack, in particular one stiffening element of one layer, is arranged at a distance from at least one stiffening element of at least one other stack, in particular at a distance from at least one stiffening element of the same layer.

Preferably, in the first state of the form element, at least one stiffening element of at least one stack, in particular one stiffening element of one layer, is arranged so as to be movable relative to at least one, in particular in a planar manner, contacting stiffening element of another, in particular adjacent, layer of at least one other stack, in particular along the planar extension of the layer.

Optionally, it is provided that, in the first state of the form element, at least one stack is connected to form a stiffening body by means of at least one fixation device, such as in particular by means of at least one screw, by means of at least one inflatable bellows, by means of at least one inflatable balloon and/or by means of at least one air piston, and that the stiffening body is inserted into at least one other stack and/or into at least one other stiffening body in a comb-like manner so that the stiffening elements of the one stiffening body project between the stiffening elements of the at least one other stack and/or the at least one other stiffening body.

By means of the fixation device, the stiffening elements, which are stacked on top of each other and/or lie on top of each other, can be connected to form a stiffening body. This means that, optionally, the stiffening elements connected to form the stiffening body may be connected to one another in both the first and second states of the form element, in particular substantially immovably.

Preferably, in the first state and/or in the second state of the form element, at least one stiffening element of at least one stiffening body, in particular one stiffening element of one layer, is arranged at a distance from at least one stiffening element of at least one other stiffening body, in particular at a distance from at least one stiffening element of the same layer.

Preferably, in the first state of the form element, at least one stiffening element of at least one stiffening body, in particular one stiffening element of one layer, is arranged so as to be movable relative to at least one, in particular in a planar manner, contacting stiffening element of another, in particular adjacent, layer of at least one other stiffening body, in particular along the planar extension of the layer.

Optionally, the fixation device is designed as an inflatable fixation device, in particular as a bellows, balloon or air piston. Optionally, a contact pressure can be generated by inflating, whereby the stiffening elements can be pressed together and connected to form a stiffening body.

The contact pressure generated by the inflatable fixation device may act on the stiffening elements over a large area. Further, by using a plurality of inflatable fixation devices, it may be possible to substantially simultaneously connect the stiffening elements to one another, in particular reversibly, at different points of the form element and, optionally, to substantially simultaneously create a plurality of stiffening bodies.

Preferably, the form element comprises a plurality of balloons, bellows and/or air pistons.

Optionally, it is provided that, in the first state, the stiffening bodies can be moved relative to one another along the planar extension of their stiffening elements and that, in the second state, the stiffening bodies are fixed relative to one another via the stiffening elements that are pressed together.

Optionally, it is provided that the stiffening elements of at least one layer are arranged at a distance from one another, and that the stiffening elements of this layer are connected via at least one, in particular elastically, deformable stiffening body.

The deformable stiffening bodies may be made of rubber, caoutchouc, polyurethane, latex, silicone or other elastic materials, or may comprise rubber, caoutchouc, polyurethane, latex, silicone or other elastic materials.

In the first state of the form element, the deformability of the at least one connecting body allows the layers and in particular the stiffening elements of the respective layer to be moved relative to one another along their planar extension.

In the second state, the layers, in particular the stiffening elements, may be connected to one another transversely, in particular normal, to their planar extension to solidify the form element.

Optionally, it is provided that the stiffening elements of one layer are arranged at a distance from one another, whereby at least one clearance is kept free between the stiffening elements of this layer, and that this clearance of the layer is arranged offset relative to at least one clearance of at least one other layer, in particular at least one clearance of at least one adjacent layer, along its planar extension.

The fact that the stiffening elements of a layer can be arranged at a distance from one another means that there are clearances between the stiffening elements. These clearances can allow the stiffening elements to move towards and away from one another.

Preferably, the distance between the stiffening elements of a layer, in particular the length of the clearance, is 1% up to and including 30%, in particular 5% up to and including 30%, of the length of the respective stiffening element.

Optionally, it is provided that the stiffening elements are flexibly bendable flat bodies, and/or that the stiffening elements have an elastic modulus in the range of 0.3 MPa up to and including 30 MPa, in particular in the range of 1 MPa up to and including 3 MPa, and/or that the stiffening elements are, in particular pressure- and tension-resistant in the second state of the form element.

Preferably, the stiffening elements are heat-resistant, cold-resistant, moisture-resistant and/or permanently elastic.

In particular, the surfaces of the stiffening elements have high friction coefficients, in particular a friction coefficient greater than 0.1, preferably a friction coefficient greater than 0.5. These properties may be achieved by having a suitable surface structure, the suitable materials and/or surface coatings.

Optionally, it is provided that, in the first state of the form element, at least one stiffening element of one layer is arranged so as to be movable relative to at least one stiffening element of another layer, and that this movement extends preferably along the planar extension of the respective layer and/or the planar extension of the respective stiffening element.

Optionally, it is provided that, in the second state of the form element, at least one stiffening element of one layer is connected to at least one stiffening element of at least one other layer to solidify the form element, and that this connection is preferably made transversely, in particular normal, to the planar extension of the respective layer and/or the planar extension of the respective stiffening element.

In particular, it is provided that, in the first state of the form element, at least one stiffening element of one layer is arranged so as to be movable relative to at least one stiffening element of another layer, in particular relative to at least one stiffening element of an adjacent layer, preferably along the planar extension of the respective layer and/or the planar extension of the respective stiffening element.

In particular, it is provided that, in the second state of the form element, at least one stiffening element of one layer is connected to at least one stiffening element of at least one other layer, in particular to at least one stiffening element of an adjacent layer, in particular normal to the planar extension of the respective layer and/or the planar extension of the respective stiffening element, to solidify the form element.

In the context of the present invention, a movement of a stiffening element along its planar extension may be understood as the direction in which the stiffening element extends in a planar manner and/or the direction which follows the surface of the respective stiffening element.

Due to the fact that, in the first state of the form element, the stiffening elements of a layer are arranged so as to be movable and/or displaceable relative to stiffening elements of another, in particular adjacent, layer along their planar extension, the form element can be deformed three-dimensionally and flexibly.

Further, in the first state of the form element, the stiffening elements of one layer may be arranged so as to be movable and/or displaceable relative to the stiffening elements of the same layer. Preferably, it is provided that the clearance between the stiffening elements is dimensioned in such a way that the stiffening elements do not contact each other during the deformation of the form element even when moved relative to one another.

Preferably, it is provided that at least one stiffening element of one layer is arranged at a distance from at least one stiffening element of an adjacent layer so as to enable a movement of the layers.

To solidify the form element, the stiffening elements may be pressed together in the second state of the form element, in particular in a non-positive and/or frictional manner, in particular normal, to their planar extension.

Here, the stiffening elements of one layer may be pressed against stiffening elements of another, in particular adjacent, layer in a non-positive and/or frictional manner normal to their planar extension.

In particular, in the first state of the form element, each stiffening element may be arranged so as to be movable relative to any other stiffening element, preferably relative to any stiffening element which is, in particular in a planar manner, contacting and/or arranged below and/or above.

Optionally, it is provided that, in the second state of the form element, at least one stiffening element of one layer is non-positively, in particular reversibly, connected to at least one stiffening element of another layer.

Optionally, it is provided that the at least one stiffening element has a structure and/or a coating, in particular a rubber and/or polyurethane coating, for the frictional connection.

In particular, it is provided that, in the second state of the form element, the stiffening elements are designed such that at least one stiffening element of one layer can be connected to at least one stiffening element of at least one other layer, in particular to at least one stiffening element of an adjacent layer, in a non-positive manner, in particular reversibly.

In particular, it is provided that at least one stiffening element has a structure and/or a coating, in particular a rubber or polyurethane coating, for the non-positive connection to at least one stiffening element of another layer, in particular to at least one stiffening element on an adjacent layer.

The surface of the stiffening elements or the stiffening element itself may be configured to generate a high frictional force when the stiffening elements are pressed together.

The surface of the stiffening elements may have a structure and/or a coating.

Optionally, it is provided that at least one stiffening element is of strip-shaped, plate-shaped, circular, cross-shaped, triangular, quadrangular, polygonal and/or star-shaped design, or that all stiffening elements are of strip-shaped, plate-shaped, circular, cross-shaped, triangular, quadrangular, polygonal and/or star-shaped design.

In particular, the at least one stiffening element may be of triangular, quadrangular, pentagonal, hexagonal, heptagonal, octagonal, nonagonal, decagonal, eleven-sided, twelve-sided, thirteen-sided, fourteen-sided, fifteen-sided and/or polygonal design.

In particular, all stiffening elements may be of triangular, quadrangular, pentagonal, hexagonal, heptagonal, octagonal, nonagonal, decagonal, eleven-sided, twelve-sided, thirteen-sided, fourteen-sided, fifteen-sided and/or polygonal design.

Optionally, it may be provided that the stiffening elements are of different designs. Preferably, it is provided that all stiffening elements are of the same design.

Optionally, it is provided that at least one guiding device is provided for guiding at least one stiffening element, and that the at least one guiding device allows the relative movement of the at least one stiffening element only along one direction, wherein the direction follows the planar extension of the respective layer.

Optionally, it is provided that at least one layer, in particular the layer of the form element contacting the concrete, has a greater flexural strength than the other layers.

The harder and/or stiffer layer may enable the concrete to follow the defined shape of the form element in the second state without the form element, in particular the layer contacting the concrete, giving way.

With the form element, it may be possible to create precisely defined three-dimensional concrete components.

Optionally, it is provided that the layers, in particular the stiffening elements, are surrounded by an airtight envelope, in particular a rubber envelope, a latex envelope or a polyurethane envelope.

Preferably, it is provided that the form element is brought from its first state into its second state by extracting air, in particular by applying a vacuum.

By extracting air from the airtight envelope, in which the layers, in particular the stiffening elements, may be arranged, the layers, in particular the stiffening elements, are pressed together in a frictional and/or non-positive manner normal to their planar extension.

Being pressed together can stiffen and/or solidify the form element.

Optionally, it is provided that the form element is deformed manually, electrically, hydraulically and/or pneumatically. Further, the form element may be deformed using at least one actuator, which is optionally also controlled by the computer. For example, a template may be used for the deformation of the form element.

Preferably, it is provided that the deformed form element is brought from its first state into its second state.

In particular, the invention relates to an arrangement of at least one form element on a substructure for forming at least part of a formwork for a concrete part, wherein the substructure is formed from a support structure or the substructure comprises a support structure, wherein the at least one form element is connected to the substructure via at least one connecting device, and wherein at least one device, in particular at least one vacuum pump, is provided by means of which the at least one form element can be brought from its first state into its second state, characterized in that the at least one form element is an inventive form element.

The form element may be configured to be connected to a conventional substructure. In particular, it may be provided that at least one attachment device is provided on the form element, which can be connected to the substructure via at least one connecting device.

Further, it may be provided that two or more form element(s) are directly, such as via a tongue-and-groove-connection or via connecting elements, connected to one another. The connecting elements may be made of wood, plastic or polyurethane, for example.

The form elements may be connected and/or connectable to one another and/or to the connecting element via at least one tongue-and-groove-connection, at least one feather key, at least one slide fastener, at least one dovetail joint, at least one connecting fitting, at least one tooth coupling, at least one plug fastener and/or at least one spline connection.

Optionally, the substructure comprises metal, in particular aluminium, wood and/or plastic.

Optionally, the form elements may also be connected to the substructure via the connecting elements.

Optionally, it is provided that the substructure has a predefined deformation, and that the form element is deformable when the form element is connected to the attachment points of the deformed substructure.

Optionally, it is provided that the form element is connected to the undeformed substructure, and that the form element can be deformed by deforming the substructure.

In particular, the form element may be connected and/or connectable to the substructure via an adjustable connecting device. Optionally, it is provided that the shape, in particular the curvature, of the form element is made by adjusting this connecting device, in particular by modifying the distance between the form element and the substructure.

Optionally, the connecting device may be movable or adjustable in all directions, in particular by 360°. In this case, the connecting device may adjust to the curvature of the form element. Thereby, the connecting device is optionally aligned normal to the tangent of the curvature of the form element, preferably in the connecting region.

Optionally, it is provided that the deformed form element is connected to the deformed substructure.

In particular, the invention relates to a method for forming at least part of a formwork for a concrete part, comprising the following steps: bringing the form element into a predefined shape, the form element being in its first state during deformation, bringing the form element into its second state, in particular by extracting the air from the airtight envelope using a vacuum pump, as a result of which the layers, in particular the stiffening elements, of the form element are connected to one another, in particular reversibly, to solidify the form element, characterized in that the form element is a form element according to the invention.

Optionally, it is provided that the method steps of the method succeed one another as previously described. In this case, it is provided that the form element is first formed into a predefined shape. Subsequently, the form element is brought into its second state, as a result of which the layers, in particular the stiffening elements, are reversibly connected to one another.

Further, if a vacuum is present in the airtight envelope, repair of the airtight envelope, in particular the rubber envelope, can be easily accomplished since the material sealing the leak can be aspirated.

Optionally, the form element can also be brought into its second state via at least one bellows, at least one balloon or at least one air piston. By inflating the at least one balloon, the at least one bellows or the at least one air piston, the stiffening elements can be pressed together and the form element can be brought into its second state.

In particular, the invention relates to a form element, wherein the form element is flexibly and three-dimensionally deformable in its first state, and wherein the form element is stiffened and solidified in its second state, in particular in a deformed position of the form element, characterized in that the form element comprises at least two flexible layers which are arranged one above the other in a planar manner, and in that the layers are connected to one another, in particular reversibly, in the second state to solidify the form element.

The form element may be configured to form at least part of a formwork of any materials, as injection mold and/or as template, in particular as laminating template in boat building and/or model building. Further, the form element may be configured to act as substructure for a brick vault and/or as freeform surface for a brick construction and/or shotcrete.

This form element may have any of the above mentioned features individually or in combination.

Further features according to the invention optionally emerge from the claims, the description of the exemplary embodiments and the figures.

The invention is now explained in more detail on the basis of non-exclusive and/or non-limiting exemplary embodiments.

DETAILED DESCRIPTION OF THE PREFERRED EMBODIMENTS

Figure 1A:
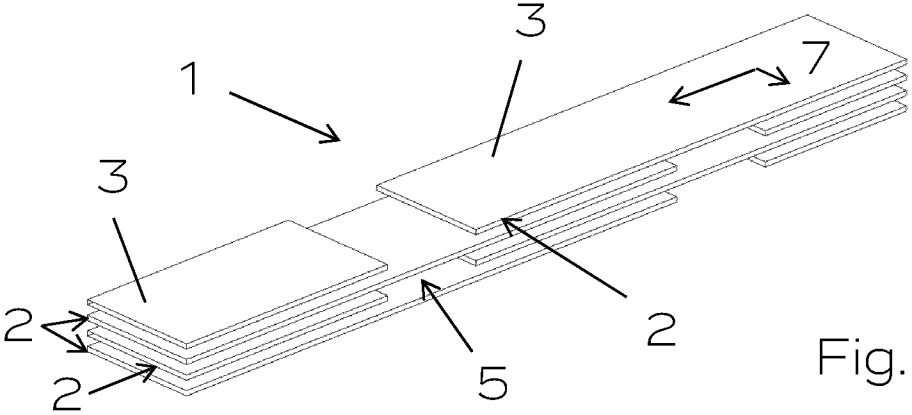
FIGS. 1*a* and 1*b* show a schematic graphical representation of a first embodiment of the inventive form element in its first state.

Unless otherwise stated, the reference signs correspond to the following components:

Form element 1, layer 2, stiffening elements 3, stack 4, clearance 5, guiding devices 6, planar extension 7, substructure 8, connecting body 9, fixation device 10 and stiffening body 11.

Figure 1B:
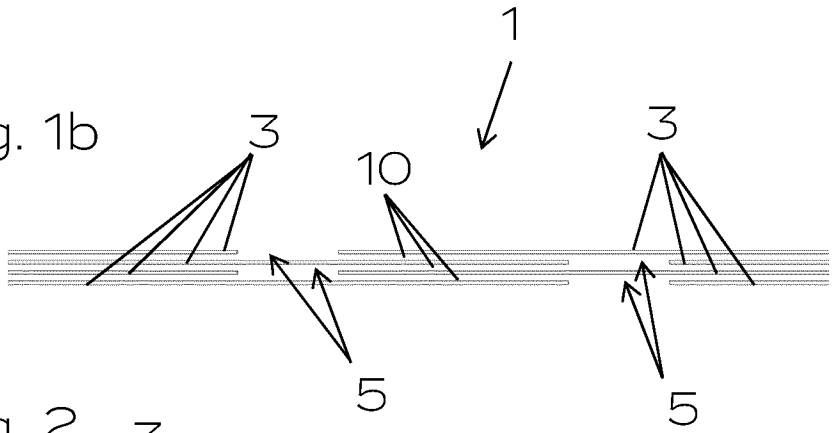

FIGS. 1*a* and 1*b* show a schematic graphical representation of the inventive form element 1 in its first state. In FIG. 1*a*, the form element 1 is illustrated in a schematic three-dimensional representation. In FIG. 1*b*, the form element 1 is illustrated in an elevation. For clarity, the airtight envelope, which surrounds the layers 2, is not shown.

The form element 1 according to this embodiment is configured to form at least part of a formwork for a concrete part. In the first state, the form element 1 is flexibly and three-dimensionally deformable.

The form element 1 comprises four flexible layers 2 which are arranged one above the other in a planar manner.

In the first state of the form element 1, the layers 2 can be moved along their planar extension 7 relative to at least one adjacent layer 2. In other words, the stiffening elements 3 of a layer 2 can be moved along the planar extension 7 of the layer 2 relative to the stiffening elements 3 arranged below and/or above. This possibility of movement of the layers 2 or stiffening elements 3 allows a three-dimensional deformation of the form element 1.

The individual layers 2 can be connected to one another exclusively in a non-positive and reversible manner to solidify and/or stiffen the form element 1 in its second state.

According to this embodiment, each layer 2 comprises two stiffening elements 3. These stiffening elements 3 of a layer 2 overlap the stiffening elements 3 of the respective adjacent layer 2.

Further, the stiffening elements 3 of a layer 2 are configured to be connected to the stiffening elements 3 of at least one adjacent layer 2 in a reversible and non-positive manner.

According to this embodiment, the stiffening elements 3 have a structure and a polyurethane coating.

The stiffening elements 3 of each layer 2 are arranged at a distance from the stiffening elements 3 of the same layer 2, keeping free clearances 5 between the stiffening elements 3 of the layer 2.

The clearances 5 of one layer 2 are arranged offset relative to the clearances 5 of the at least one adjacent layer 2 along their planar extension 7.

For clarity, the first layer 2, which contacts the concrete, is not shown. This layer 2 is made of at least one stiffening element 3 which is able to absorb occurring forces, such as concrete pressure.

Figure 2:
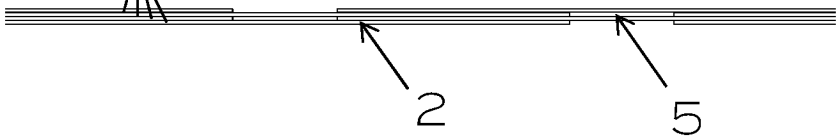
FIG. 2 shows a schematic graphical representation of the inventive form element of FIGS. 1*a* and 1*b* in its second state.

In FIG. 2, the inventive form element 1 according to FIGS. 1*a* and 1*b* is shown in its second state. The features of the embodiment according to FIG. 2 may preferably correspond to the features of the embodiments according to FIGS. 1*a* and/or 1*b*.

In the second state of the form element 1, the layers 2 are connected to at least one other layer 2, in particular to an adjacent layer 2, normal to their planar extension 7. In other words, the layers 2 of the form element 1 are pressed together in a planar manner in the second state of the form element 1.

Figure 3:
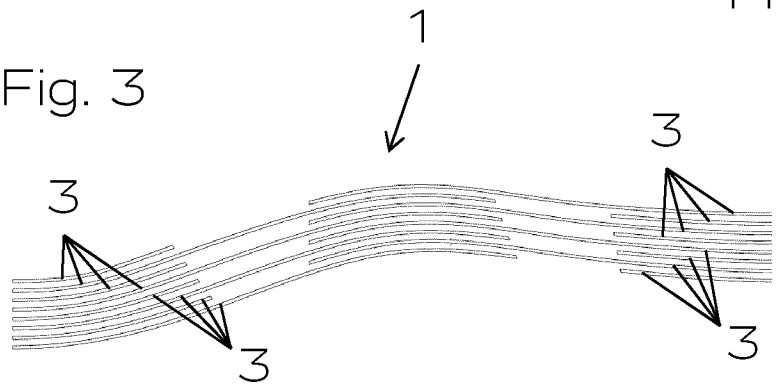
FIG. 3 shows a schematic graphical representation of the inventive form element of FIGS. 1*a* and 1*b* in a deformed first state.

FIG. 3 shows an inventive deformed form element 1 in its first state, which comprises eight layers 2. The features of the embodiment according to FIG. 3 may preferably correspond to the features of the embodiments according to FIGS. 1*a*, 1*b* and/or 2.

When the form element 1 in this deformed state is brought into its second state, a stiffened and/or solidified form element 1 with the deformation shown in FIG. 3 is obtained.

Figure 4:
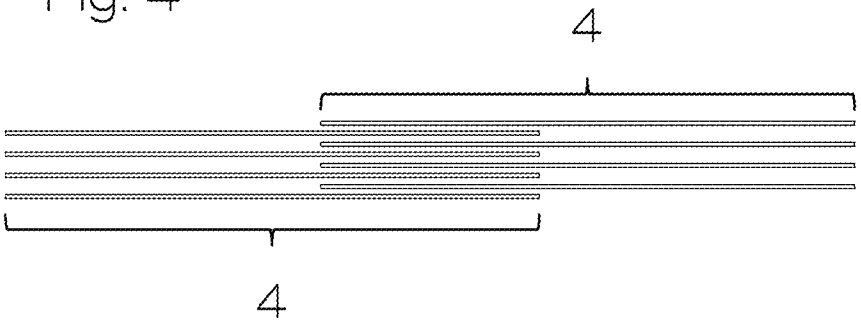
FIG. 4 shows a schematic graphical representation of stacked stiffening elements.

FIG. 4 shows an arrangement of stiffening elements 3, which are arranged substantially one above the other and form a stack 4. The features of the embodiment according to FIG. 4 may preferably correspond to the features of the embodiments according to FIGS. 1*a*, 1*b*, 2 and/or 3.

The first stack 4 is inserted into the second stack 4 in a comb-like manner so that the stiffening elements 3 of the first stack 4 project between the stiffening elements 3 of the second stack 4.

Figure 5A:
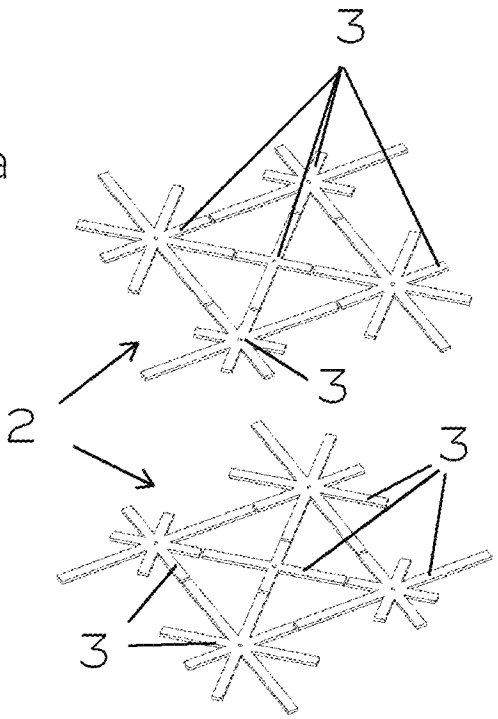
FIGS. 5*a* and 5*b* show a schematic graphical representation of an embodiment of the inventive form element with star-shaped stiffening elements.
Figure 5B:
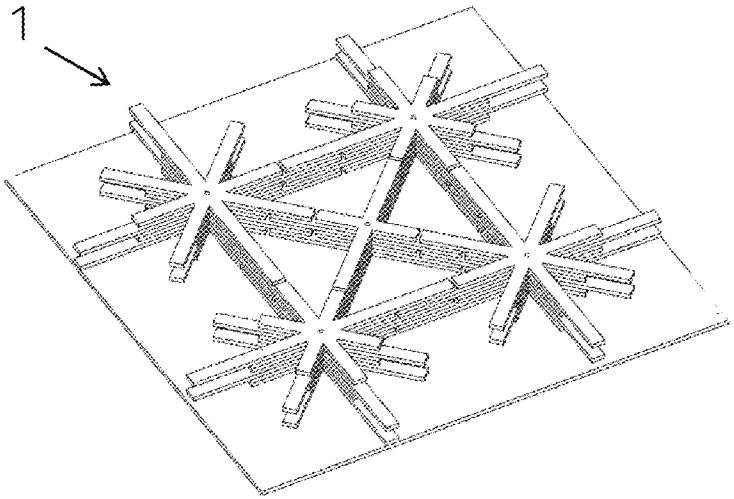

FIGS. 5*a* and 5*b* show star-shaped stiffening elements 3 and an inventive form element 1 formed therefrom. The features of the embodiment according to FIGS. 5*a* and 5*b* may preferably correspond to the features of the embodiments according to FIGS. 1*a*, 1*b*, 2, 3 and/or 4.

Figure 5D:
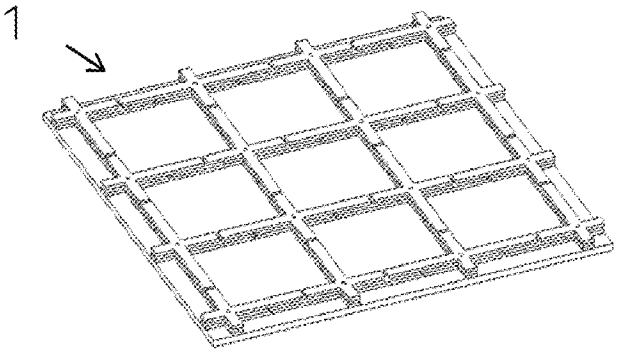
FIGS. 5*c* and 5*d* show a schematic graphical representation of an embodiment of the inventive form element with cross-shaped stiffening elements.
Figure 5F:
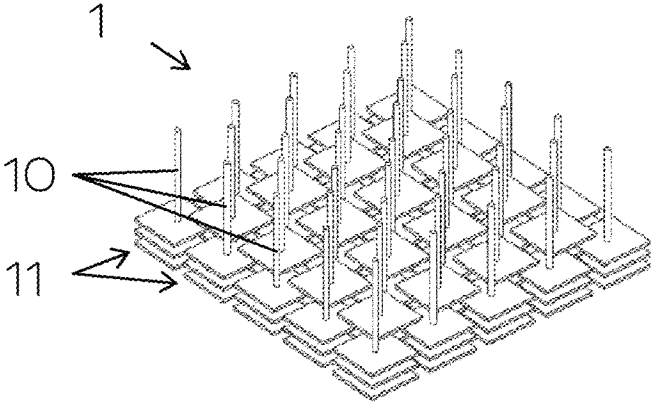
FIGS. 5*e* and 5*f* show a schematic graphical representation of an embodiment of the inventive form element with square stiffening elements.
Figure 5C:
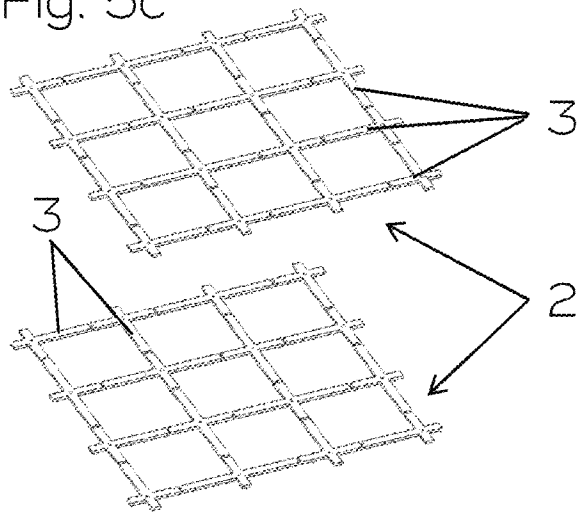

FIGS. 5*c* and 5*d* show cross-shaped stiffening elements 3 and an inventive form element 1 formed therefrom. The features of the embodiment according to FIGS. 5*c* and 5*d* may preferably correspond to the features of the embodiments according to FIGS. 1*a*, 1*b*, 2, 3, 4, 5*a* and/or 5*b*.

Figure 5E:
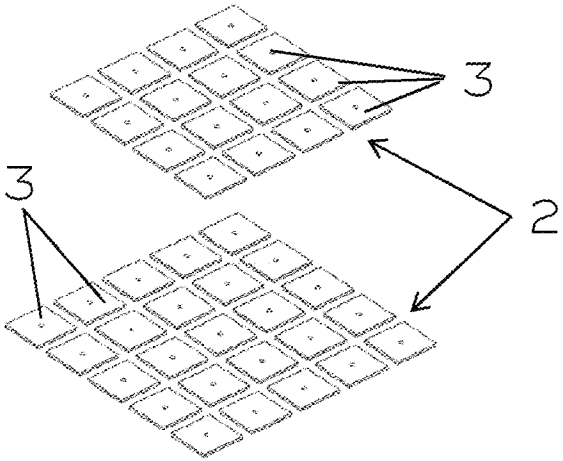

FIGS. 5*e* and 5*f* show square stiffening elements 3 and an inventive form element 1 formed therefrom. The stacked stiffening elements 3 are connected to one another via fixation devices 10 to form stiffening bodies 11. The stiffening bodies 11 are inserted into at least one other stiffening body 11 in a comb-like manner so that the stiffening elements 3 of one stiffening body 11 project between the stiffening elements 3 of the other stiffening body 11.

The features of the embodiment according to FIGS. 5*e* and 5*f* may preferably correspond to the features of the embodiments according to FIGS. 1*a*, 1*b*, 2, 3, 4, 5*a*, 5*b*, 5*c* and/or 5*d*.

Figure 6A:
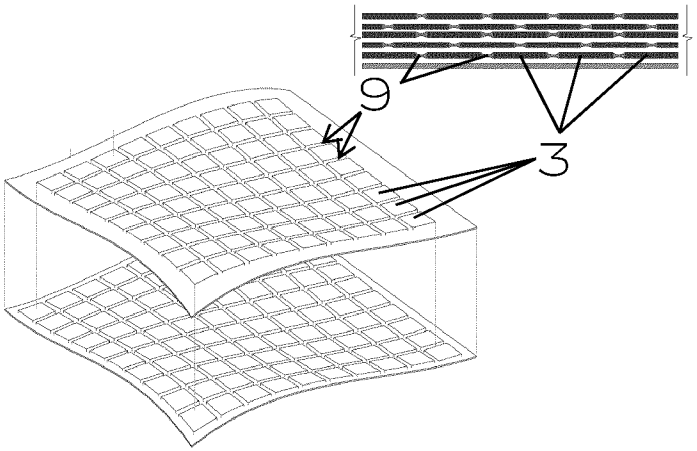
FIGS. 6*a*, 6*b* and 6*c* show schematic graphical representations of different embodiments of the inventive form element, with the stiffening elements being connected via deformable connecting bodies.

FIG. 6*a* shows a schematic graphical three-dimensional representation of an embodiment of the inventive form element and a section through this representation. According to this embodiment, the square stiffening elements 3 are connected via, in particular elastically, deformable connecting bodies 9.

Figure 6B:
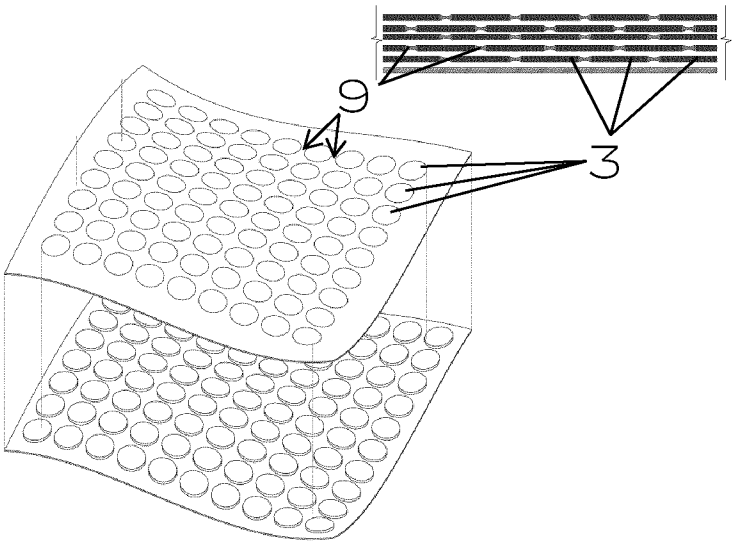

FIG. 6*b* shows a schematic graphical three-dimensional representation of an embodiment of the inventive form element and a section through this representation. According to this embodiment, the circular stiffening elements 3 are connected via, in particular elastically, deformable connecting bodies 9.

Figure 6C:
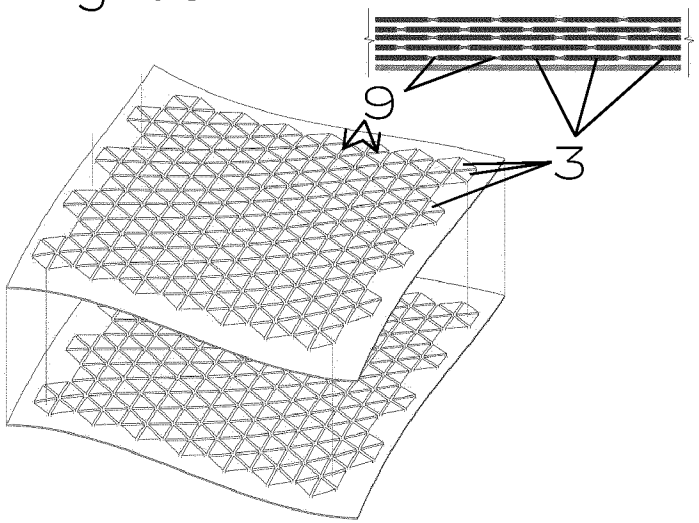

FIG. 6*c* shows a schematic graphical three-dimensional representation of an embodiment of the inventive form element and a section through this representation. According to this embodiment, the triangular stiffening elements 3 are connected via, in particular elastically, deformable connecting bodies 9.

The features of the embodiment according to FIGS. 6*a*, 6*b* and 6*c* may preferably correspond to the features of the embodiments according to FIGS. 1*a*, 1*b*, 2, 3, 4, 5*a*, 5*b*, 5*c*, 5*d*, 5*e* and/or 5*f*.

The deformable connecting bodies 9 connect the stiffening elements 3 of the respective layer 2 to one another so that, among other things, easy alignment of the stiffening elements 3 to one another is made possible during assembly.

Further, the stiffening elements 3 of one layer 2 can be moved relative to one another. In particular, a movement of the stiffening elements 3 of a layer 2, which are connected to one another, is possible preferably along the planar extension 7 of the respective layer 2 and/or the planar extension 7 of the respective stiffening element 3.

In all embodiments, it may be provided that an overlap of the stiffening elements 3 of the various layers 2 is required for the non-positive connection of the individual layers 2.

Figure 7A:
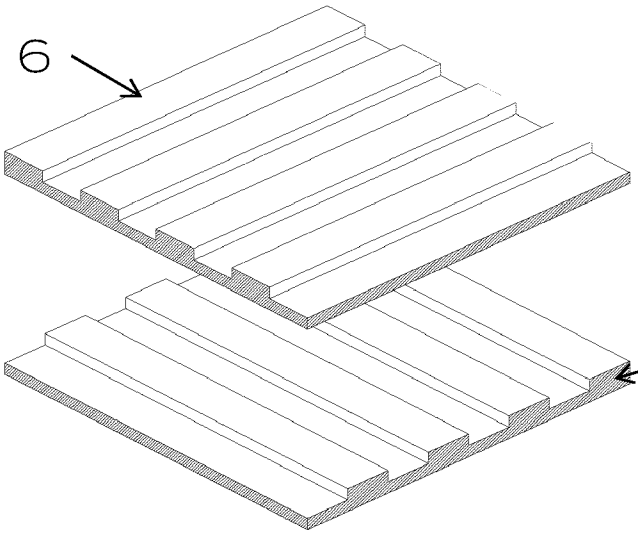
FIGS. 7*a* and 7*b* show a schematic graphical representation of an embodiment of the inventive guiding device.
Figure 7B:
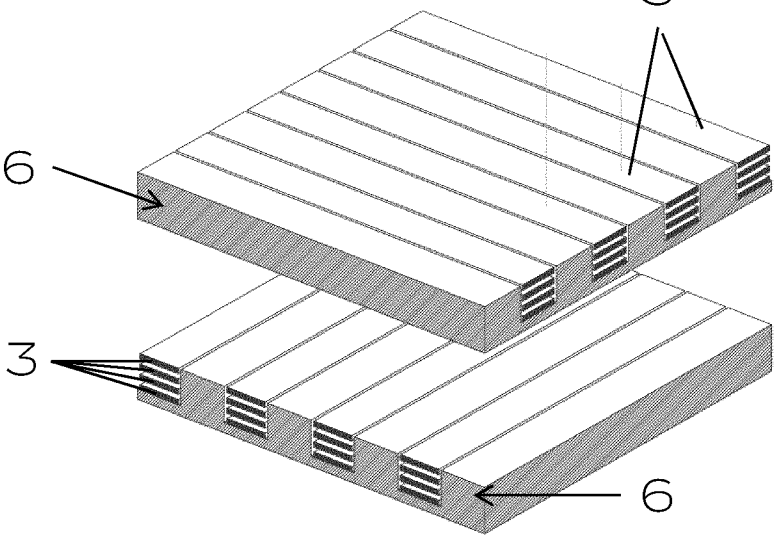

FIGS. 7*a* and 7*b* show a first embodiment of a guiding device 6 according to the invention. The features of the embodiment according to FIGS. 7*a* and 7*b* may preferably correspond to the features of the embodiments according to FIGS. 1*a*, 1*b*, 2, 3, 4, 5*a*, 5*b*, 5*c*, 5*d*, 5*e*, 5*f*, 6*a*, 6*b* and/or 6*c*.

In FIG. 7*a*, the guiding device 6 is shown without stiffening elements 3 and in FIG. 7*b*, the guiding device 6 is shown with stiffening elements 3 arranged therein.

The guiding device 6 allows the relative movement of the stiffening elements 3 arranged therein to be limited. In particular, the guiding device 6 enables a relative movement only along one direction, this direction following the planar extension 7 of the respective layer 2.

Figure 8A:
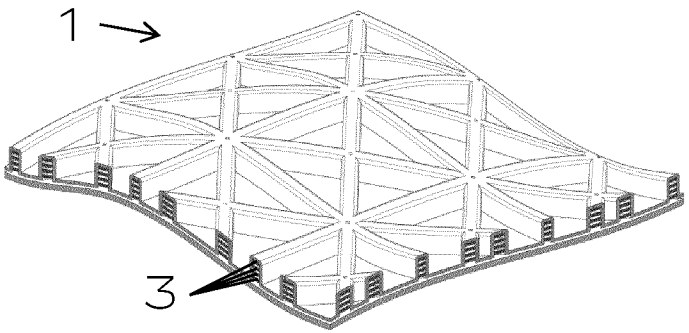
FIGS. 8*a* and 8*b* show a schematic graphical representation of another embodiment of the inventive form element.
Figure 8B:
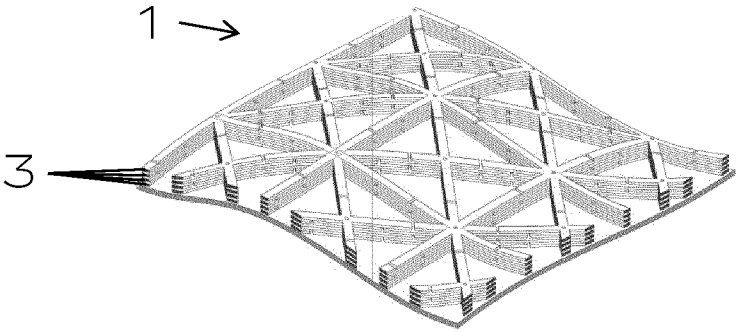

FIGS. 8*a* and 8*b* show schematic graphical representations of another embodiment of an inventive form element in a deformed position, wherein the stiffening elements 3 are shown with an envelope in FIG. 8*a* and without an envelope in FIG. 8*b*.

The stiffening elements 3 of the layers 2 of this embodiment are stacked one on top of the other. The stacks 4 are inserted into at least one other stack 4 in a comb-like manner so that the stiffening elements 3 of one stack 4 project between the stiffening elements 3 of the at least one other stack 4.

The layer 2 of the form element 1 contacting the concrete has a greater flexural strength than the other layers 2. This layer 2 is configured in such a way that the concrete follows the defined shape of the form element 1 in the second state without the form element 1, in particular the layer 2 in contact with the concrete, giving way.

Thus, the form element 1 allows to produce precisely defined three-dimensional concrete components.

Figure 9:
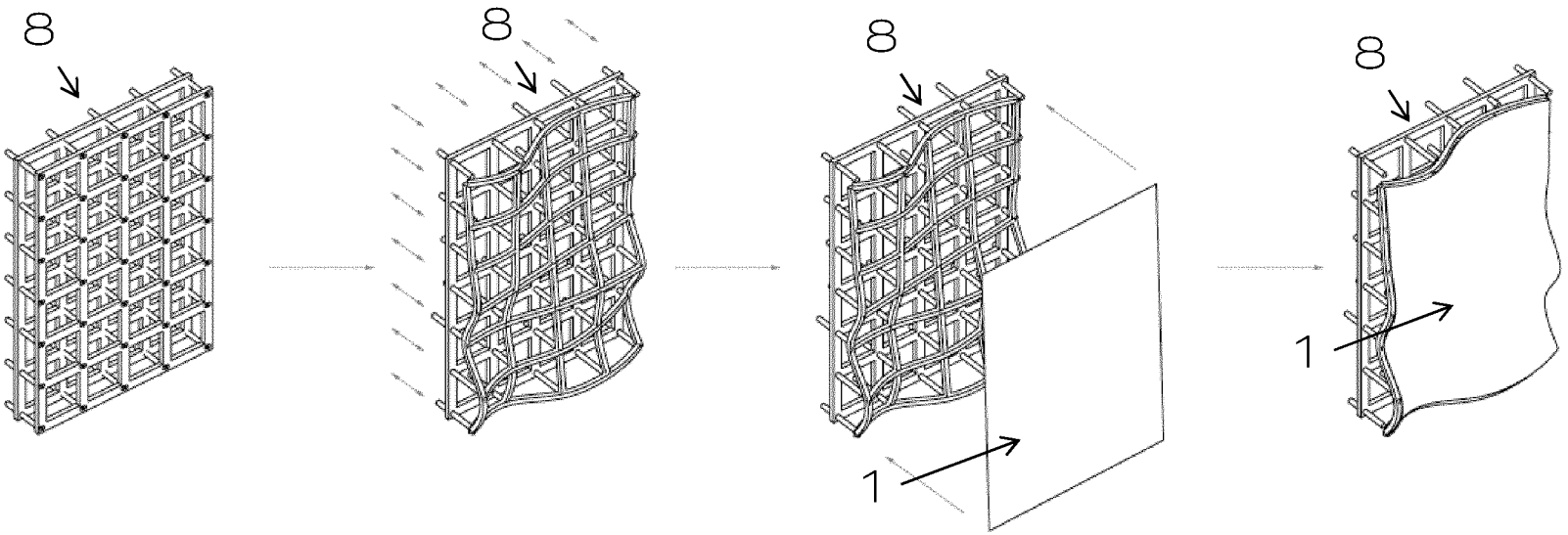
FIGS. 9, 10 and 11 show different arrangements of the inventive form element on a substructure.
Figure 10:
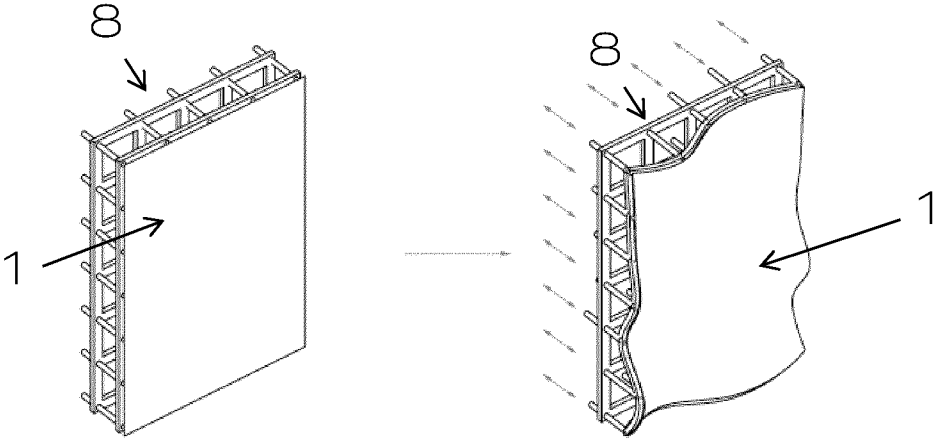

The features of the embodiments according to FIGS. 9, 10 and/or 11 may preferably correspond to the features of the embodiments according to FIGS. 1*a*, 1*b*, 2, 3, 4, 5*a*, 5*b*, 5*c*, 5*d*, 5*e*, 5*f*, 6*a*, 6*b*, 6*c*, 7*a* and/or 7*b*.

Figure 11A:
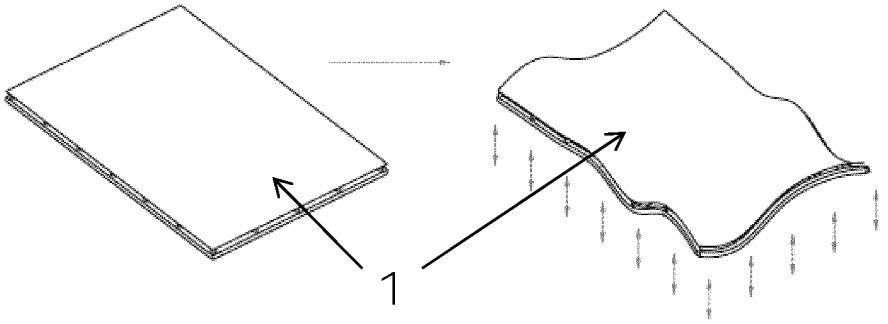
Figure 11B:
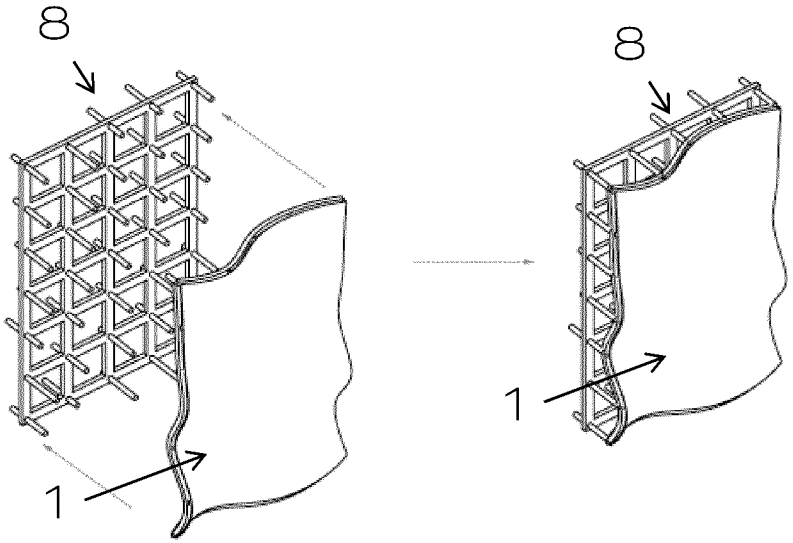

FIGS. 9, 10 and 11 show different arrangements of an inventive form element 1 on a substructure 8 for forming at least part of a formwork for a concrete part. The features of the embodiments according to FIGS. 9, 10 and/or 11 may preferably correspond to the features of the embodiments according to FIGS. 1*a*, 1*b*, 2, 3, 4, 5*a*, 5*b*, 5*c*, 5*d*, 5*e*, 5*f*, 6*a*, 6*b*, 6*c*, 7*a*, 7*b*, 8*a* and/or 8*b*.

According to FIG. 9, the substructure 8 is adjusted to a defined shape and/or deformed into a defined shape. Subsequently, the form element 1 is attached to the substructure 8 in its first state via at least one connecting device, as a result of which the form element 1 can be formed into the desired shape.

Once the form element 1 has reached its desired shape, the form element 1 can be brought from its first state into its second state, whereby the form element 1 is stiffened and solidified.

According to FIG. 10, the form element 1 can be connected to an undeformed substructure 8 in its first state. Subsequently, the substructure 8 and the form element 1 connected to it can be deformed.

Once the form element 1 has reached its desired shape, the form element 1 can be brought from its first state into its second state, whereby the form element 1 is stiffened and solidified.

According to FIG. 11, the form element 1 can be deformed in its first state, can then be brought into its second state and can subsequently be connected to a substructure 8.

This configuration may be provided in all embodiments.

This exemplary configuration allows the effects according to the invention to be obtained.

The invention is not limited to the illustrated embodiments, but rather comprises any form element 1, arrangement and method according to the following patent claims.

The invention claimed is:

1. A form element for forming at least part of a formwork for a concrete part, comprising:

a plurality of flexible layers which are arranged one above the other in a planar manner, wherein the plurality of flexible layers have a first configuration and a second configuration;

wherein, in the first configuration, the form element is flexibly and reversibly and three-dimensionally deformed into a double-curved surface by movement of at least one layer of the plurality of flexible layers along its planar extent relative to an adjacent layer of the plurality of flexible layers; and wherein, in the second configuration, the form element is stiffened and solidified in a deformed position by reversible connection of at least one layer of the plurality of flexible layers to an adjacent layer of the plurality of flexible layers which presses together adjacent layers and solidifies the form element.

2. The form element according to claim 1, wherein:

each layer of the plurality of flexible layers is formed from or comprises at least one stiffening element, and at least one given stiffening element of one layer overlaps at least one given stiffening element of an adjacent layer.

3. The form element according to claim 2, further comprising:

a plurality of stacks, wherein each stack is formed by a plurality of stiffening elements arranged one above the other, wherein a given stack is inserted into at least one other stack in a comb-like manner so that the plurality of stiffening elements of the given stack project between the plurality of stiffening elements of the at least one other stack.

4. The form element according to claim 2, further comprising:

a plurality of stacks, wherein each stack is formed by a plurality of stiffening elements arranged one above the other, wherein, in the first configuration, at least one given stack forms a stiffening body by means of at least one magnetic fixation device or at least one inflatable bellows or at least one air piston, and the stiffening body is inserted into at least one other stack or other stiffening body in a comb-like manner so that the stiffening elements of the stiffening body project between the stiffening elements of the at least one other stack or the other stiffening body.

5. The form element according to claim 4, wherein:

in the first configuration, the stiffening body and the other stiffening body are configured to move relative to one another along the planar extent of their stiffening elements, and in the second configuration, the stiffening body and the other stiffening body are fixed relative to one other via the stiffening elements, which are pressed together.

6. The form element according to claim 2, wherein:

a plurality of stiffening elements of at least one layer are spaced from one another and are connected via at least one elastically deformable connecting body.

7. The form element according to claim 2, wherein:

a plurality of stiffening elements of one layer are spaced from one another, thus keeping free clearance between the plurality of stiffening elements of this layer, and the clearance of this layer is arranged offset relative to clearance of another adjacent layer along its planar extent.

8. The form element according to claim 2, wherein:

a plurality of stiffening elements of at least one layer comprise flexibly bendable flat bodies, wherein the plurality of stiffening elements have an elastic modulus in the range of 1 MPa to 3 MPa, and wherein the plurality of stiffening elements are pressure- and tension-resistant in the second configuration.

9. The form element according to claim 2, wherein:

in the first configuration, at least one particular stiffening element of one layer moves relative to at least one other stiffening element of another layer.

10. The form element according to claim 2, wherein:

in the second configuration, at least one particular stiffening element of one layer is connected to at least one other stiffening element of another layer to solidify the form element.

11. The form element according to claim 2, wherein:

in the second configuration, at least one particular stiffening element of one layer is reversibly connected to at least one other stiffening element of another layer to solidify the form element.

12. The form element according to claim 11, wherein:

the at least one particular stiffening element of the one layer has a structure for connecting to the at least one other stiffening element of the other layer.

13. The form element according to claim 2, wherein:

at least one particular stiffening element comprises at least one of a strip-shaped, plate-shaped, circular, cross-shaped, triangular, quadrangular, polygonal or star-shaped design, or a plurality of stiffening elements comprises at least one of a strip-shaped, plate-shaped, circular, cross-shaped, triangular, quadrangular, polygonal or star-shaped design.

14. The form element according to claim 2, further comprising:

a guiding device for guiding at least one stiffening element, wherein this guiding device enables the relative movement of the stiffening element along a singular direction that follows the planar extent of the corresponding layer.

15. The form element according to claim 1, wherein:

at least one layer of the form element that is operably disposed in contact with the concrete has a greater flexural strength than the other layers.

16. The form element according to claim 1, wherein:

the plurality of flexible layers are surrounded by an airtight envelope formed from a material selected from a rubber, a latex or a polyurethane.

17. The form element according to claim 11, wherein:

the at least one particular stiffening element of the one layer has a rubber or polyurethane coating for connecting to at least one particular stiffening element of the other layer.

18. The form element according to claim 1, wherein:

in the second configuration, the reversible connection which presses together adjacent layers and solidifies the form element is provided by at least one magnetic fixation device.

19. The form element according to claim 1, further comprising:

an airtight envelope that surrounds the plurality of flexible layers;

wherein, in the second configuration, the reversible connection which presses together adjacent layers and solidifies the form element is provided by at least one pump configured to extract air from the airtight envelope.

20. An arrangement of at least one form element on a substructure for forming at least part of a formwork for a concrete part, wherein the substructure is formed from or comprises a supporting structure, wherein the at least one form element comprises a form element according to claim 1 that is connected to the substructure via at least one connecting device, wherein at least one vacuum pump is configured to provide means by which the plurality of layers of at least one form element are brought from its first configuration into its second configuration.

21. A method for forming at least part of a formwork for a concrete part with a form element according to claim 1, comprising:

bringing the form element into a predefined shape, the form element being in its first configuration during deformation, bringing the form element into its second configuration by extracting air from an airtight envelope with a vacuum pump to solidify the form element, wherein the airtight envelope surrounds the plurality of flexible layers.

22. A form element for forming at least part of a formwork for a concrete part, comprising:

a plurality of flexible layers which are arranged one above the other, wherein the plurality of flexible layers have a first configuration and a second configuration; and an airtight envelope that surrounds the plurality of flexible layers;

wherein, in the first configuration, the form element is flexibly and reversibly and three-dimensionally deformed by movement of at least one layer of the plurality of flexible layers relative to an adjacent layer of the plurality of flexible layers;

wherein, in the second configuration, the form element is stiffened and solidified in a deformed position by reversible connection of at least one layer of the plurality of flexible layers to an adjacent layer of the plurality of flexible layers which solidifies the form element, which is provided by at least one pump configured to extract air from the airtight envelope.

* * * * *